US009561814B2

(12) United States Patent
Geduhn et al.

(10) Patent No.: US 9,561,814 B2
(45) Date of Patent: Feb. 7, 2017

(54) METHOD FOR OPERATING AN AUTOMATIC TRAIN CONTROL SYSTEM AND AUTOMATIC TRAIN CONTROL SYSTEM

(71) Applicant: SIEMENS AKTIENGESELLSCHAFT, Munich (DE)

(72) Inventors: Norbert Geduhn, Uetze (DE); Zhenxiang Yang, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/893,168

(22) PCT Filed: Apr. 22, 2014

(86) PCT No.: PCT/EP2014/058075

§ 371 (c)(1),
(2) Date: Nov. 23, 2015

(87) PCT Pub. No.: WO2014/187626

PCT Pub. Date: Nov. 27, 2014

(65) Prior Publication Data

US 2016/0144877 A1 May 26, 2016

(30) Foreign Application Priority Data

May 21, 2013 (DE) ..... 10 2013 209 307

(51) Int. Cl.
*B61L 27/00* (2006.01)
*B61L 3/12* (2006.01)
(Continued)

(52) U.S. Cl.
CPC ..... *B61L 27/0038* (2013.01); *B61L 3/121* (2013.01); *B61L 19/06* (2013.01); *B61L 23/16* (2013.01); *B61L 2027/0044* (2013.01)

(58) Field of Classification Search
CPC ..... B61L 3/121; B61L 19/06; B61L 23/16; B61L 2027/0044
See application file for complete search history.

(56) References Cited

FOREIGN PATENT DOCUMENTS

CN 101065283 A 10/2007
CN 102107672 A 6/2011
(Continued)

OTHER PUBLICATIONS

Simis W electronic interlocking, Safe and economical Siemens AG—Industry Sector—Mobility Division; 2008.
(Continued)

*Primary Examiner* — Michael D Lang
(74) *Attorney, Agent, or Firm* — Laurence Greenberg; Werner Stemer; Ralph Locher

(57) ABSTRACT

A method operates an automatic train control system which has an electronic signal box, a balize and a frequency track circuit. To configure the train control system so as to be constructed from components of the European train control system and of the frequency track circuit without substantial additional development effort, the balize is acted upon by indicator messages of a first type of the electronic signal box via an actuation module for modular elements having an addressable memory for the number of currently free block route segments. Indicator messages of a third type are created from indicator messages of a second type. A functional relationship between the addresses of the memory and code information of the frequency track circuit is taken into account during the creation of the third indicator messages. A transmitter of the frequency track circuit is acted upon as a result of the third indicator messages.

8 Claims, 1 Drawing Sheet

(51) Int. Cl.
*B61L 19/06* (2006.01)
*B61L 23/16* (2006.01)

(56) References Cited

FOREIGN PATENT DOCUMENTS

| | | | | | |
|---|---|---|---|---|---|
| CN | 102233886 | A | | 11/2011 | |
| CN | 102259657 | A2 | | 11/2011 | |
| CN | 102320316 | A | | 1/2012 | |
| DE | EP2112045 | | * | 10/2008 | ..... B61L 1/08 |
| DE | 102008045050 | A1 | | 3/2010 | |
| EP | 1607300 | A2 | | 12/2005 | |
| WO | 2009130152 | A1 | | 10/2009 | |
| WO | 2012155832 | A1 | | 11/2012 | |

OTHER PUBLICATIONS

"Gleisfreimeldeanlage", Wikipedia, pp. 1-4 , URL: http://wikipedia.org/wiki/Gleisfreimeldeanlage.

"Chinese Train Control System", Wikipedia, pp. 1-2, URL: http://de.wikipedia.org/wiki/Chinese_Train_control_System.

"European Train Control System", Wikipedia, pp. 1-7 , URL: http://de.wikipedia.org/wiki/European_Train-Control-System.

Wang Changlin; "Chinese High Speed Railway Train Control System"; Southwest Jiaotong University; URL: http://www.emsd.gov.hk/emsd/e_download/about/symposium/2011/session/ppt7M4_PPT_CL Wang.pdf; XP055168689; 2011.

* cited by examiner

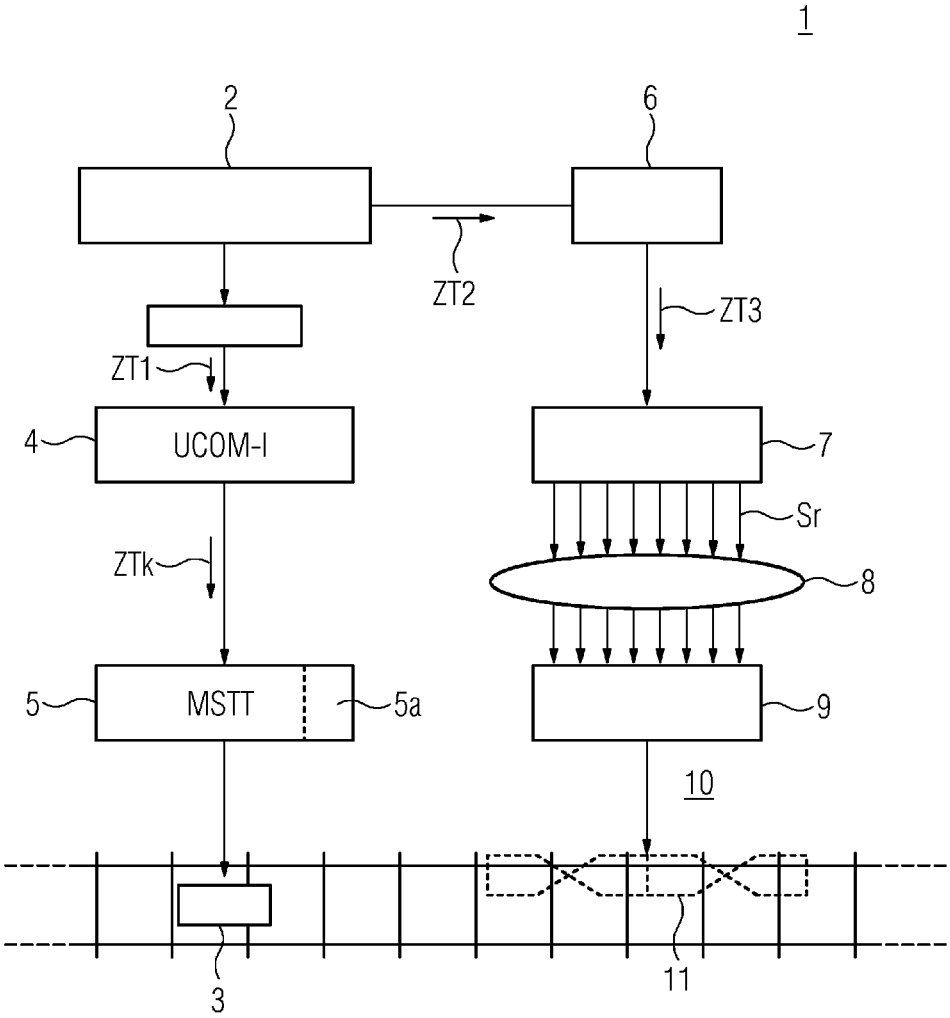
1
2
6
ZT2
ZT3
ZT1
4
UCOM-I
7
Sr
ZTk
8
5
MSTT
5a
9
10
3
11

METHOD FOR OPERATING AN AUTOMATIC TRAIN CONTROL SYSTEM AND AUTOMATIC TRAIN CONTROL SYSTEM

Method for operating an automatic train control system and automatic train control system

BACKGROUND OF THE INVENTION

Field of the Invention

As a method for operating an automatic train control system comprising an electronic interlocking, it is known to employ track vacancy detection systems. Said track vacancy detection systems can be of different design, in particular they can be implemented as audio-frequency track circuits, as cited, for example, in the reference http://de.wikipedia.org/wiki/Gleisfreimeldeanlage.

Also known is the European Train Control System (ETCS) which is a component part of a standard European Rail Transport Management System ERTMS. This ETCS system can have different levels, including ETCS Level 1 which allows traffic also on lines employing conventional national train protection systems.

In an ETCS Level 1 system, so-called Eurobalises installed in the track are used as the transmission medium and communicate information concerning line gradients, maximum line speeds and points at which the vehicle is to come to a stand again. Details can be found, for example, in http://de.wikipedia.org/wiki/European_Train_Control_System, pages 1 to 7.

Also known is the Chinese Train Control System (CTCS) which employs a track circuit and balises in a CTCS Level 2 configuration, as described in http://de.wikipedia.org/wiki/Chinese_Train_Control_System.

Brief Summary of the Invention

The object of the invention is to propose method for operating an automatic train control system comprising an electronic interlocking having connected balise and connected frequency track circuit, wherein said method can be implemented simply using known train protection system components.

This object is achieved by a method for operating an automatic train control system comprising an electronic interlocking with connected balise and connected frequency track circuit, wherein, by means of pointer telegrams of a first kind (first pointer telegrams) generated by the electronic interlocking, the balise is actuated via an operating module for modular elements which has an addressable memory for the number of currently vacant block sections, and pointer telegrams of a second kind (second pointer telegrams) generated by the electronic interlocking are used to create pointer telegrams of a third kind (third pointer telegrams), wherein a functional relationship between the memory addresses and code information of the frequency track circuit is taken into account for creating the third pointer telegrams, and, in response to these third pointer telegrams, at least one transmitter of a frequency track circuit is actuated via a relay arrangement.

A significant advantage of the method according to the invention is that it can basically be implemented using components that are known from train control systems having balises and from train control systems having frequency track circuits and introduced there, so that in an electronic interlocking for the just mentioned train control systems it is merely necessary, by additionally creating second pointer telegrams and third pointer telegrams, to create a train control system which can be used for operation using balises and frequency track circuits. The functional relationship taken into account for creating the third pointer telegrams can be of differing complexity.

The method according to the invention is particularly advantageous if, when Chinese Train Control System (CTCS) Level 2 pointer telegrams are used as the first pointer telegrams and ETCS Level 1 pointer telegrams are used as the second pointer telegrams, a CTCS balise is installed as the balise, and a bijective function is used for creating the third pointer telegrams. This makes it possible, using an electronic interlocking according to ETCS Level 1 and a known frequency track circuit, to operate a train control system having the features of the CTCS system and therefore able to be used in China. Trains running in the Chinese train control system CTCS area can therefore also be controlled using an electronic interlocking of the ETCS train control system without significant additional engineering being required for this purpose.

The invention is based on the insight that the addresses in the addressable memory of the operating module are very similar to the code information for the frequency track circuit of the CTCS system, as will be explained in detail below, so that a relatively simple functional relationship exists between the memory addresses and the code information of the frequency track circuit.

With the method according to the invention it is also advantageous if the first pointer telegrams are converted into communications telegrams in a telegram converter. This makes it possible to transmit pointer telegrams reliably even over longer distances.

For reliable control of the frequency track circuit it is advantageous to feed the third pointer telegrams to a digital input/output device in which operating signals for the relay arrangement are generated.

The invention also relates to an automatic train control system comprising an electronic interlocking having a connected balise and a connected frequency track circuit and has the object of organizing said train control system such that it can be built up from components of the European Train Control System and of the frequency track circuit without significant additional developmental complexity.

This object is achieved by an automatic train control system comprising an electronic interlocking having a connected balise and a connected frequency track circuit and generating pointer telegrams of a first kind (first pointer telegrams) and pointer telegrams of a second kind (second pointer telegrams), additionally comprising an operating module for modular elements, said operating module being connected to the electronic interlocking and having an addressable memory for the number of vacant block sections and the thereto connected balise as a modular element, and comprising a pointer telegram creator connected to the electronic interlocking, said pointer telegram creator creating pointer telegrams of a third kind (third pointer telegrams) taking a functional relationship between the memory addresses and code information of the frequency track circuit into account, also comprising a digital input/output device connected to the pointer telegram creator, said input/output device generating operating signals for a downstream relay arrangement, and, connected to said relay arrangement, at least one transmitter of the frequency track circuit.

A significant advantage of the train control system according to the invention is considered to be the fact that it can be built up using known components of the ETCS train control system and from known components of the frequency track circuit; only minor development work has to be carried to produce the pointer telegram creator and the digital input/output device.

Further advantages of the automatic train control system according to the invention will emerge from claims 6 to 8, said advantages corresponding analogously to the above mentioned embodiments of the method according to the invention.

For further explanation of the invention, the drawing shows an exemplary embodiment of the train control system according to the invention in the form of a block diagram.

BRIEF DESCRIPTION OF THE DRAWING

The single FIGURE of the drawing is a block diagram of a train control system according to the invention.

DESCRIPTION OF THE INVENTION

As FIG. 1 specifically shows, the train control system 1 presented has an electronic interlocking 2 which can preferably be the Simis W electronic interlocking by Siemens Aktiengesellschaft designed for the ETCS train control system, as described in a publication "Simis W electronic interlocking Safe and economical" (2008).

Pointer telegrams of the first kind, i.e. first pointer telegrams ZT1, of the type provided for a balise 3 according to the Chinese CTCS Level 2 are generated by the electronic interlocking 2. In a converter 4 downstream of the electronic interlocking 2 or more specifically in a component known in the industry as UCOM-I for short, the first pointer telegrams ZT1 are converted into communications-type pointer telegrams ZTk, e.g. using ISDN technology. These converted pointer telegrams ZTk are fed to an operating module 5 for modular elements which is termed MSTT in the technical language. The operating module 5 contains an addressable memory 5*a* (not shown) having addresses provided according to the number of vacant block sections of the balise 3. Depending on the number of currently vacant block sections, the balise 5 is actuated accordingly by the operating module 5.

Disposed downstream of the electronic interlocking 2 in the exemplary embodiment shown is a pointer telegram creator 6 in which pointer telegrams of a third kind, i.e. third pointer telegrams ZT3, are created from pointer telegrams of a second kind, i.e. second pointer telegrams ZT2 generated by the electronic interlocking 2, as will be explained in greater detail below. Disposed downstream of the pointer telegram creator 6 is an input/output device 7 termed UNOM/INOM for short which generates operating signals Sr for a downstream relay arrangement 8 from the digital third pointer telegrams ZT3. Connected to said relay arrangement 8 is a transmitter 9 of a frequency track circuit 10 which generates signals in a state corresponding to the signal state of the balise 3. These signals can be picked off from a track vacancy detection system 11 by a rail vehicle.

Table 1 below shows the relationship between a number of converted pointer telegrams ZTk, a number of addresses Add1 to Add6 of the memory 5*a* and the meaning of the respective memory location, wherein the table reproduces only one section of a complete table.

TABLE 1

| Addresses of memory 5a | Meaning | Converted pointer telegrams ZTk |
|---|---|---|
| Add 1 | 8 block sections ahead clear | Telegram 1 |
| Add 2 | 7 block sections ahead clear | Telegram 2 |
| Add 3 | 6 block sections ahead clear | Telegram 3 |

TABLE 1-continued

| Addresses of memory 5a | Meaning | Converted pointer telegrams ZTk |
|---|---|---|
| Add 4 | 5 block sections ahead clear | Telegram 4 |
| Add 5 | 4 block sections ahead clear | Telegram 5 |
| Add 6 | 3 block sections ahead clear | Telegram 6 |
| . . . | . . . | . . . |

Another Table 2 shows code information L5 to LU for the frequency track circuit 10 of the CTCS Level 2 system and its respective meaning, wherein code information LU2 which stands for two clear block sections ahead is also taken into account.

TABLE 2

| Code information | Meaning |
|---|---|
| L5 | 8 block sections ahead clear |
| L4 | 7 block sections ahead clear |
| L3 | 6 block sections ahead clear |
| L2 | 5 block sections ahead clear |
| L | 4 block sections ahead clear |
| LU | 3 block sections ahead clear |
| . . . | . . . |

Comparing the two tables with one another, it can be seen that a comparatively simple functional relationship exists between the addresses of the memory 5*a* in the operating module 5 for the balise 3 and the code information for the frequency track circuit 10, which relationship can be described by a bijective function. This function is provided by a telegram creator 6 so that, by means of the third pointer telegrams ZT3, the transmitter 9 and therefore also the track vacancy detection system 11 of the frequency track circuit 10 is actuated via the input/output device 7 and the relay arrangement 8 in the same way as the balise 3.

Thus it is therefore possible, by introducing a simple bijective function and using a relay arrangement, to create a CTCS Level 2 system from components of the ETCS system and of a frequency track circuit with relatively little cost/complexity.

The invention claimed is:

1. A method for operating an automatic train control system containing an electronic interlocking connected to a balise and a frequency track circuit, which comprises the steps of:

actuating the balise via an operating module for modular elements by means of pointer telegrams of a first kind, namely first pointer telegrams, of the electronic interlocking, the operating module having an addressable memory for a number of currently clear block sections;

creating pointer telegrams of a third kind, namely third pointer telegrams, from pointer telegrams of a second kind, namely second pointer telegrams, of the electronic interlocking, wherein a functional relationship between addresses of the addressable memory and code information of the frequency track circuit is taken in to account for creating the third pointer telegrams; and actuating at least one transmitter of the frequency track circuit via a relay arrangement in response to the third pointer telegrams.

2. The method according to claim 1, which further comprises:

providing a Chinese train control system (CTCS) level 2 pointer telegrams as the first pointer telegrams; and providing a European train control system level 2 pointer telegrams as the second pointer telegrams;

providing a CTCS balise as the balise; and using a bijective function for creating the third pointer telegrams.

3. The method according to claim 1, which further comprises converting the first pointer telegrams into communications telegrams in a telegram converter.

4. The method according to claim 1, which further comprises feeding the third pointer telegrams to a digital input/output device in which operating signals for the relay arrangement are generated.

5. An automatic train control system, comprising:

an electronic interlocking generating pointer telegrams of a first kind, namely first pointer telegrams, and pointer telegrams of a second kind, namely second pointer telegrams;

a balise connected to said electronic interlocking;

a frequency track circuit connected to said electronic interlocking and having at least one transmitter;

an operating module for modular elements connected to said electronic interlocking, said operating module having an addressable memory for a number of clear block sections and having said balise as one of said modular elements;

a pointer telegram creator connected to said electronic interlocking, said pointer telegram creator creating the pointer telegrams of a third kind, namely third pointer telegrams taking a functional relationship between addresses of said addressable memory and code information of said frequency track circuit into account;

a relay arrangement connected to said at least one transmitter of said frequency track circuit; and a digital input/output device connected to said pointer telegram creator, said digital input/output device generating operating signals for said relay arrangement disposed downstream of said digital input/output device.

6. The train control system according to claim 5, wherein in a case of the first pointer telegrams as Chinese train control system level 2 (CTCS-L2) pointer telegrams and the second pointer telegrams as European train control system level 2 (ETCS-L1) pointer telegrams, said pointer telegram creator is implemented such that the third pointer telegrams are created from the second pointer telegrams according to a bijective function, and said balise is a CTCS balise.

7. The train control system according to claim 5, further comprising a telegram converter, said operating module is connected to said electronic interlocking via said telegram converter.

8. The train control system according to claim 5, wherein the first pointer telegrams are Chinese train control system level 2 pointer telegrams and the second pointer telegrams are European train control system level 2 pointer telegrams.

* * * * *